US010573285B1

(12) United States Patent
Bonner

(10) Patent No.: US 10,573,285 B1
(45) Date of Patent: Feb. 25, 2020

(54) PORTABLE ELECTRONIC MUSICAL SYSTEM

(71) Applicant: Mark J. Bonner, Watertown, NY (US)

(72) Inventor: Mark J. Bonner, Watertown, NY (US)

( * ) Notice: Subject to any disclaimer, the term of this patent is extended or adjusted under 35 U.S.C. 154(b) by 0 days.

(21) Appl. No.: 16/104,164

(22) Filed: Aug. 17, 2018

Related U.S. Application Data

(63) Continuation-in-part of application No. 15/679,457, filed on Aug. 17, 2017, now Pat. No. 10,255,894.

(60) Provisional application No. 62/546,714, filed on Aug. 17, 2017, provisional application No. 62/451,894, filed on Jan. 30, 2017.

(51) Int. Cl.
*G10H 1/34* (2006.01)

(52) U.S. Cl.
CPC ..... *G10H 1/344* (2013.01); *G10H 2220/096* (2013.01)

(58) Field of Classification Search
CPC ..... G10H 1/344; G10H 2220/096
USPC ..... 84/723
See application file for complete search history.

(56) References Cited

U.S. PATENT DOCUMENTS

| | | | | |
|---|---|---|---|---|
| 2,002,144 A | | 5/1935 | Heaton | |
| 2,511,557 A | | 6/1950 | Arnold | |
| 3,226,754 A | | 1/1966 | Brittain | |
| 3,591,298 A | | 7/1971 | Green | |
| 3,665,092 A | * | 5/1972 | Heiman | G10B 1/08 84/351 |
| D253,010 S | | 9/1979 | Gueret et al. | |
| 4,177,698 A | | 12/1979 | Greneker | |
| D254,035 S | | 1/1980 | Gueret et al. | |
| 4,213,472 A | | 7/1980 | Gueret et al. | |
| 4,414,437 A | | 11/1983 | Grimes | |
| 4,414,537 A | * | 11/1983 | Grimes | A61B 5/1114 341/20 |
| 4,613,139 A | * | 9/1986 | Robinson, II | G06F 3/014 200/DIG. 2 |
| 4,621,935 A | | 11/1986 | Sussman | |
| 4,635,516 A | * | 1/1987 | Giannini | G10H 1/32 2/160 |

(Continued)

FOREIGN PATENT DOCUMENTS

| | | | |
|---|---|---|---|
| CA | 1251957 A | * | 4/1989 |
| JP | H05150771 | | 6/1993 |

OTHER PUBLICATIONS

Unofficial File History for U.S. Pat. No. 7,674,969 Issued Mar. 9, 2010.

(Continued)

*Primary Examiner* — David S Warren
*Assistant Examiner* — Christina M Schreiber

(57) ABSTRACT

Disclosed is a portable electronic musical system including a pad with a plurality of touch sensitive elements, usable with a single hand. Information produced as a result of pressure being applied to one of the plurality of touch sensitive elements on the pad is captured with an electronic subsystem. The captured information is communicated to a sound producing subsystem for producing musical output. A selectively positionable support mechanism is operatively connectable to the pad, so that when at least part of the support mechanism is positioned under at least part of the single hand, all of the pad, the positionable support mechanism and the single hand are movable in unison.

17 Claims, 5 Drawing Sheets

(56) References Cited

U.S. PATENT DOCUMENTS 4,681,012 A * 7/1987 Stelma ..... G10D 13/06 2/160
4,915,234 A 4/1990 Boeller
5,029,508 A * 7/1991 Suzuki ..... G10H 1/34 84/616
5,046,394 A * 9/1991 Suzuki ..... G10H 1/0553 250/227.14
5,115,706 A * 5/1992 Aluisi ..... G10D 13/024 84/723
5,151,553 A * 9/1992 Suzuki ..... G10H 1/0558 341/20
5,166,463 A * 11/1992 Weber ..... G10H 1/00 84/600
5,216,193 A * 6/1993 Masubuchi ..... G10H 1/0558 338/99
D339,235 S 9/1993 Hirzel
5,338,891 A * 8/1994 Masubuchi ..... G10H 1/0558 84/600
5,512,703 A * 4/1996 Usa ..... G10H 1/0558 84/600
5,571,020 A * 11/1996 Troudet ..... G09B 5/065 2/160
5,581,484 A * 12/1996 Prince ..... G06F 3/014 340/407.1
5,944,434 A 8/1999 Schlatter
6,262,355 B1 * 7/2001 Koch ..... G10H 1/34 84/600
6,304,840 B1 * 10/2001 Vance ..... G06F 3/014 703/21
6,587,090 B1 * 7/2003 Jarra ..... G06F 3/033 345/156
6,734,349 B1 * 5/2004 Adams ..... G10D 13/003 84/315
6,885,316 B2 * 4/2005 Mehring ..... G06F 3/014 341/21
7,078,610 B2 * 7/2006 Mori ..... G10H 3/146 84/604
7,112,739 B2 * 9/2006 Mori ..... G10H 1/0091 84/737
7,214,336 B2 5/2007 Sheridan et al.
7,381,884 B1 * 6/2008 Atakhanian ..... G10H 1/34 84/477 R
7,674,969 B2 * 3/2010 Xu ..... G10H 1/24 84/615
7,723,605 B2 * 5/2010 Gremo ..... G10H 1/344 84/615
7,842,879 B1 * 11/2010 Carter ..... G10H 3/143 84/600
8,362,350 B2 * 1/2013 Kockovic ..... G10H 1/34 84/743
8,461,445 B2 * 6/2013 Takehisa ..... G10H 1/24 84/615
8,662,091 B2 3/2014 Jang
D743,481 S * 11/2015 Uesugi ..... D17/22
9,905,207 B2 * 2/2018 Louhivuori ..... G10H 1/0008
9,959,854 B2 * 5/2018 Sims ..... G10H 3/146
10,186,243 B2 * 1/2019 Bhamra ..... G10H 1/00
10,255,894 B1 * 4/2019 Bonner ..... G10H 1/34
2002/0118175 A1 * 8/2002 Liebenow ..... G06F 1/1626 345/168
2002/0140680 A1 * 10/2002 Lu ..... G06F 1/1626 345/169
2004/0112204 A1 * 6/2004 Javelle ..... G10H 1/34 84/645
2006/0171758 A1 * 8/2006 Kleve ..... G06F 3/0219 400/489
2007/0057922 A1 * 3/2007 Schultz ..... G06F 3/03547 345/173
2008/0127803 A1 * 6/2008 Liu ..... G10D 13/024 84/411 R
2009/0101163 A1 4/2009 Brunner
2010/0064880 A1 * 3/2010 Takehisa ..... G10H 1/24 84/609
2010/0064881 A1 * 3/2010 Takehisa ..... G10H 3/146 84/609
2011/0142528 A1 6/2011 Charlton
2011/0209599 A1 * 9/2011 Aponte ..... G10H 1/0008 84/723
2011/0228962 A1 * 9/2011 Taylor ..... G10H 1/0008 381/322
2013/0169420 A1 * 7/2013 Blount, Jr. ..... G06F 3/014 340/12.5
2013/0239782 A1 * 9/2013 Yoshihama ..... G10H 7/00 84/609
2015/0133193 A1 * 5/2015 Stotler ..... G06F 1/163 455/557
2016/0175186 A1 * 6/2016 Shadduck ..... A61H 19/34 601/15
2016/0365078 A1 * 12/2016 Sims ..... G10H 3/146
2017/0025106 A1 * 1/2017 Bucak ..... G10H 1/055
2017/0262060 A1 * 9/2017 Katsuki ..... G06F 3/038
2017/0308166 A1 * 10/2017 Mallinson ..... G06F 3/014

OTHER PUBLICATIONS

"Gest: Work With Your Hands," Gest—Kickstarter, https://www.kickstarter.com/projects/asdffilms/gest-work-with-your-hands; Mar. 8, 2017; 20 pages.
"MusicGlove Hand Rehabilitation System," MedGadget (http://www.medgadget.com), http://www.medgadget.com/2014/10/musicglove-hand-rehabilitation-sys . . . Mar. 8, 2017, 7 pages.
"Sound on Intuition Translates Body Movements Into Music," Antoine Carbonnaux; https://motherboard.vice.com/en_us/article/sound-on-intuition-translates-body-motion-into, Mar. 8, 2017, 8 pages.
Fingertip sensor musical switch wearable, Google Search; https://www.google.com/search?q=fingertip+sensor+musical+switch+wearable&sa=N&espv=2&biw=1920&bih., May 3, 2017, 13 pages.
"Raspberry Pi Music Fingers," Carmellitio Andrade, http://www.instructables.com/id/Raspberry-Pi-Music-Fingers/?ALLSTEPS,Mar. 8, 2017, 20 pages.
"Sound intuition: This technology will turn your movements into music," by Holden Frith, http://www.cnn.com/2013/08/21/tech/innovation/sound-intuition-this-technology/, Aug. 21, 2013, 3 pages.

* cited by examiner

PORTABLE ELECTRONIC MUSICAL SYSTEM

Priority is claimed under 35 U.S.C. § 119(e) to U.S. Provisional Patent Application No. 62/546,714, entitled Portable Electronic Musical System, filed Aug. 17, 2017 by Mark J. Bonner; and this application is a continuation-in-part and claims priority from U.S. patent application Ser. No. 15/679,457, entitled Wearable Electronic Musical Instrument, filed on Aug. 17, 2017 by Mark J. Bonner, which further claims priority from U.S. Provisional Patent Application No. 62/451,894, entitled Finger Mounted Musical Keyboard, filed Jan. 30, 2017 by Mark J. Bonner; and the disclosures of all these applications are hereby incorporated by reference in their entirety.

The present disclosure relates to a portable electronic musical system and more particularly to at least one touch pad with the touch pad including touch receptive elements as well as a hand support. Input from the touch receptive elements is used to produce selected musical output.

BACKGROUND AND SUMMARY

Keyboard instruments existed as early as the third century BC where the Ancient Greeks used a type of pipe organ known as the "hydraulis." The piano, which began to gain widespread popularity as early as the $18^{th}$ century, saw considerable improvement, in design, throughout the $19^{th}$ century. While it was not uncommon, even in the $20^{th}$ century, to have an upright piano, or even grand, piano, in a home, the popularity of the piano, due to its inherent bulkiness, has diminished in popularity (in terms of consumer demand).

Electric pianos, first developed in the early $20^{th}$ century, used metal strings with a magnetic pickup, an amplifier and a loudspeaker. By the beginning of the $21^{st}$ century, electric piano technology had evolved to hybrid variations such as the "electronic keyboard." An electronic keyboard, typically including a keyboard used in conjunction with a synthesizer (including a power amplifier) and small loudspeakers, is capable of recreating a wide range of musical sounds.

The dynamic range of the electronic keyboard has been greatly increased through use of the musical instrument digital interface (MIDI)—a standard for digital code transmission and digital technology development. When the electronic keyboard is used as a MIDI controller, MIDI data (including, for instance, information about note pitch, as well as duration) can be used to trigger sounds from a sound module or synthesizer. Capability of the electronic keyboard, when used in the context of a MIDI controller, can be greatly enhanced by use with a computer executing one or more software applications.

One current trend in music composition includes adapting an electronic keyboard into a wearable musical instrument. Several examples of wearable musical apparatus usable with a pair of hands are described in U.S. Provisional Patent Application No. 62/451,894, entitled Finger Mounted Musical Keyboard, filed Jan. 30, 2017, the respective disclosure of which is incorporated herein by reference, and a comprehensive discussion of prior art corresponding with wearable musical instruments is provided in U.S. Pat. No. 8,362,350, the disclosure of which is incorporated herein by reference. The '350 Patent discloses a wearable trigger electronic music system that can simulate any kind of music, anywhere and at any time. For example, one can create all the benefits of the percussion instrument, such as a drum kit, without its cost and burden. The same also applies to string, wind, and other types of instruments of any nation, culture, motif, era, age, etc. The system includes constituent components, including sensors, transducers, electronics, music modules, pre-amps, and amplifiers, wired or wireless, with connections for intra- and inter-modules, including final enjoyment by wired or wireless headphones or speakers. Also delineated is the process of creating music for the DIY enthusiast.

It is understood that piano applications ("apps") are available for use with conventional "smartphones" having, for instance, iPhone or Android operating systems. In one example of operation, a keyboard is displayed, via a touch-screen, and displayed keys can be programmed to correspond with selected musical notes.

While wearable musical instruments and instrument apps for smartphones can be quite well suited for their respective intended purposes, they might not fulfill the particular needs of users seeking a portable, electronic musical instrument that is both easy to play and reasonably inexpensive. That is, while a wearable musical instrument can provide a very satisfying musical experience, the playing of such instruments can be, at least for some users, quite challenging. Additionally, while instrument apps can also provide a very satisfying musical experience, some may find the expense of owning a smartphone, for the mere purpose of obtaining the dedicated functionality of a portable, electronic musical instrument, to be excessive. Finally, while users typically play keyboard instruments with two hands, this can be difficult to do with a smartphone since using a smartphone, particularly when providing input to the smartphone, can require two hands—one to secure the smartphone and another to manipulate the touch elements.

In accordance with a first aspect of the present specification, there is disclosed a portable electronic musical system, with the electronic musical system including a hand pad. The hand pad includes a plurality of touch sensitive elements, usable with a single hand, wherein information corresponding with a musical note is produced when a selected amount of pressure is applied to one of the plurality of touch sensitive elements. The electronic musical system further includes (1) an electronic subsystem, operatively associated with the pad, for capturing the information produced as a result of pressure being applied to the one of the plurality of touch sensitive elements; (2) a selectively positionable support mechanism operatively connectable and secured to the pad, and (3) a sound producing subsystem, operatively communicating with the electronic subsystem, for receiving the captured information from the electronic subsystem and producing musical output with the captured information. wherein. When the hand pad is used with the single hand, at least part of the selectively positionable support mechanism is positioned under at least part of the single hand so that all of the hand pad, the positionable support mechanism and the single hand are movable in unison.

In accordance with a second aspect of the present specification, there is disclosed a keyboard for an electronic musical system. The electronic musical system includes: a first hand pad, including a plurality of touch sensitive elements, wherein a first set of information corresponding with a first musical output is produced when a selected amount of pressure is applied to one of the plurality of touch sensitive elements of the first hand pad by a user, and wherein said first hand pad is used with one of a user's left hand and right hand; a first selectively positionable support mechanism, the first selectively positionable support mechanism being operatively connected with the first hand pad and in contact with the one of the user's left hand and right hand when the first hand pad is in use; a second hand pad, including a plurality of touch sensitive elements and being separate from the first hand pad, wherein a second set of information corresponding with a second musical output is produced when a selected amount of pressure is applied to one of the plurality of touch sensitive elements of the second hand pad, and wherein the second hand pad is used with the other one of the user's left hand and right hand; and a second selectively positionable support mechanism, the second selectively positionable support mechanism being operatively connected with the second hand pad and in contact with the other one of the user's left hand and right hand when the second hand pad is in use.

DETAILED DESCRIPTION

Figure 1:
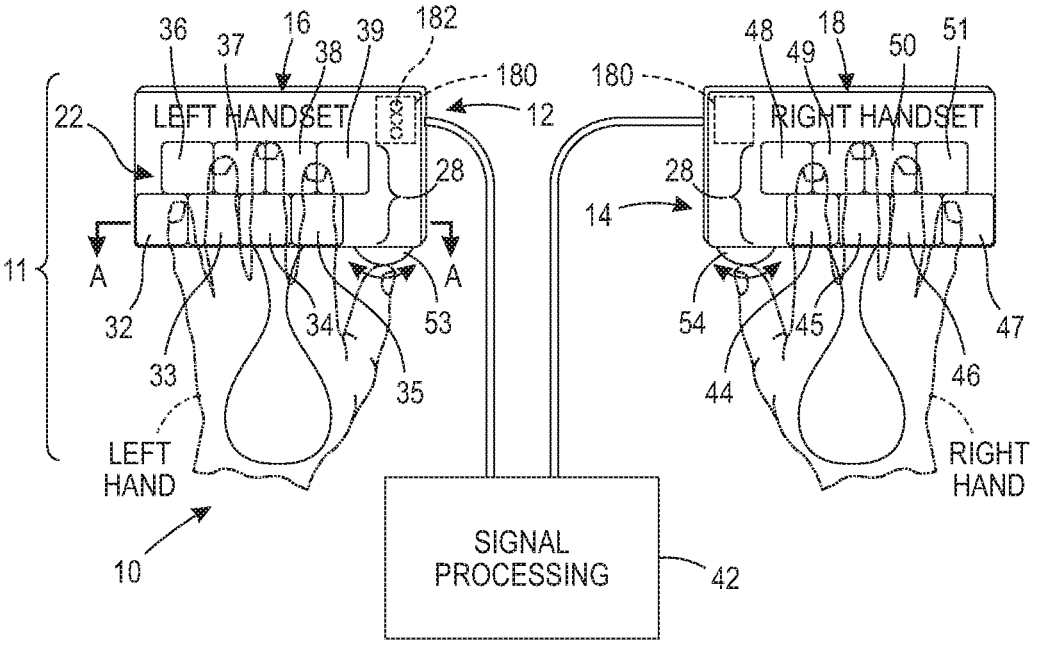
FIG. 1 is a schematic, planar view of an electronic musical system including an input section (with associated left-hand and right-hand pads)

Referring initially to FIG. 1, an electronic musical system is designated by a numeral 10, and an input section for the electronic musical system is designated by a numeral 11. The input section 11 includes a left hand pad and a right hand pad designated respectively by numerals 12 and 14. The pads 12 and 14 include housings or casings 16 and 18, respectively.

Figure 2:
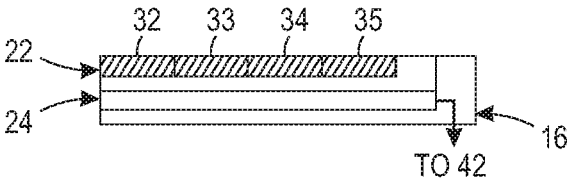
FIG. 2 is a cross sectional view of the left-hand pad of FIG. 1, as view along sight line A-A.

Referring to FIGS. 1 and 2, a cross sectional view of the left-hand pad 12, taken along sight line A-A, illustrates that the housing or casing 16 of left hand pad 12 physically supports both a key pad 22 and an electronic subsystem 24. The key pad 22 is in operative communication with the electronic subsystem 24. The key pad 22 includes touch sensitive elements 28. For the illustrated example of FIG. 1, one set of elements 32-35 is, as described below, configured to correspond with four musical whole notes, while another set of elements 36-39 is, as described below, configured to correspond with four musical half notes. In other contemplated examples, the touch sensitive elements 28 could be configured to correspond with several other types of musical notes or musical outputs available on musical instruments.

In one exemplary implementation, the electronic subsystem 24 includes electronic or microelectronic components such as microcontrollers, memory and, for example, an application-specific integrated circuitry (ASIC), any one or a combination of which can be programmed for generating a variety of information (e.g., signals) corresponding to input from each one or a combination of the elements 32-39 as the element(s) 32-39 is pressed with a fingertip or the like. While the illustrated embodiment contemplates an electronic subsystem for each one of the pads 12 and 14, it is contemplated that a unitary electronic subsystem could be provided for use with both of the pads, possibly operatively associating the unitary electronic subsystem with a signal processing subsystem—designated in FIG. 1 with the numeral 42—using wired or wireless communications.

Referring still to FIGS. 1 and 2, the electronic subsystem 24 is in operative communication with a state altering element 53. The state altering element permits selective correspondence between elements 23-39 and, in one example, an ASIC with a gate array design. As can be understood by those skilled in the art, the elements 23-39 can be mapped to different sets of interconnections with the gate array structure. Accordingly, the state altering element 53 can be used to selectively shift selected combinations of notes from one octave to another, from one instrument to another, etc. In one example, the element 53 can assume the form of one of the following: a binary or multi-position switch, a push-button switch, an encoder, a hall-effect encoder, a roller-switch, a rocker switch, a scroll wheel, a scroll ball, a trackball, or joystick. Various types of sensors could also be similarly employed for sensing motion or pressure applied to element 53. For example various forms of contact-type sensors could include force sensors (including stress or strain sensors), a capacitive, resistive or other touch-pad type sensors, heat or vibration sensors, whereas non-contact type sensors that may be used may include an accelerometer, light, infrared or other photometric sensors. Accordingly, the disclosed embodiments may suitably employ any one or a combination of switches or sensors provided that the movement of element 53 causes or results in the generation or change of a signal.

As illustrated in FIG. 1, the right-hand pad 14 includes touch elements 44-51 and state altering element 54. While the design and structure of pad 12 is intended to be similar or even identical to that of pad 14, the elements 23-29 and 44-51 are offset from one another to accommodate for use with different hands. Moreover, the respective locations of state altering elements 53, 54 are positioned to accommodate for the respective positions of the thumbs when using the left hand with the left-hand pad and the right hand with the right-hand pad.

Figure 3:
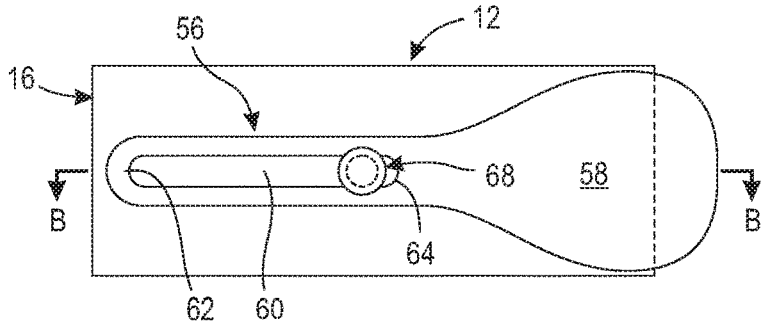
FIG. 3 is a schematic, planar view of a hand support in a storage position on a back side of one of the pads.
Figure 4:
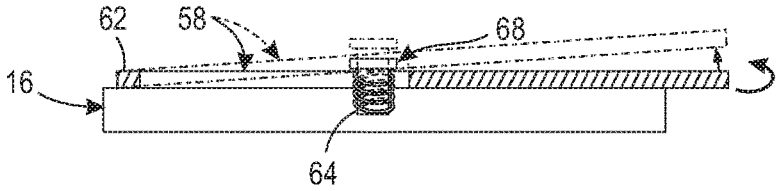
FIG. 4 is a cross sectional view of the pad of FIG. 3, as viewed along sight lines B-B, illustrating, among other things, how the hand support can be lifted relative to the back side of the pad.
Figure 5:
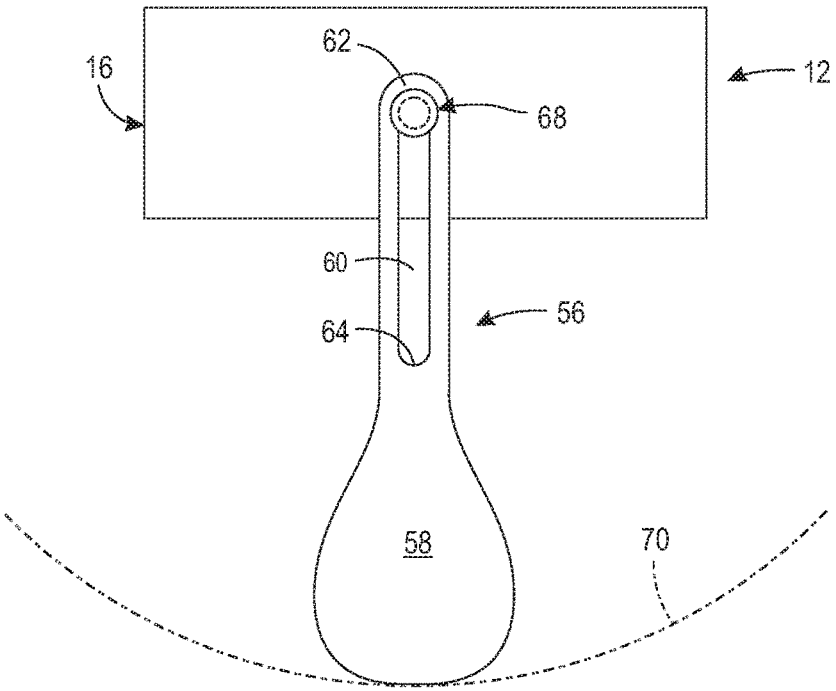
FIG. 5 is a schematic, planar view of one embodiment in which the hand support is selectively positioned away from the storage position.

Referring now to FIGS. 1 and 3-6, a hand support, operatively secured to or mounted on the back side of casing 16, is designated by a numeral 56. The support 56 includes a paddle shaped member 58 having a slot 60. The slot defines a trailing edge 62 and a forward edge 64. Referring first to FIGS. 3 and 4, in a first embodiment, the paddle 58 is operatively secured firmly against the casing 16 by use of a biasing member 68, such as a spring-loaded pin. For storage purposes, the paddle 58 is positioned so that the trailing edge of the paddle is substantially adjacent a short edge of the casing 16, while the forward edge 64 is positioned adjacent the biasing member 68.

Referring specifically to FIG. 4, in operation of the first embodiment, the biasing member 68 is lifted (either by hand or pulling up on the paddle 58) and the paddle is slid to position the trailing edge 62 anywhere between its initial storage position, with the trailing edge substantially adjacent the short edge of the casing 16, and the biasing member 68. In turn, as further illustrated in FIG. 5, the paddle 58 is rotated (pivoted) to a point along arc 70 for providing support to a portion of the left hand of a user while the left-hand pad 12 is in use. In other words, the elongated paddle 58 of hand support 56, while operatively secured to the pads (12 or 14), is both slidable and rotatable (pivotable) relative to the associated pad to allow the hand support to be selectively positioned relative to the associated pad as desired by a user.

As will be appreciated by those skilled in the art, the right-hand pad 14 is implemented in accordance with the first embodiment, except the pad 14 essentially mirrors the pad 12, accommodating for right hand use of pad 14. As will be further appreciated, some or all of the components of pad 12 can be replicated in, pad 14. In one example, each one of pads 12 and 14 can be outfitted with or connected to an electronic subsystem 24 or communicate with a unitary electronic subsystem of the type described above. Additionally, the touch sensitive elements 44-51 can be obtained through suitable configuration of a key pad 28, and the right-hand pad is preferably outfitted with a hand support 56.

Figure 6:
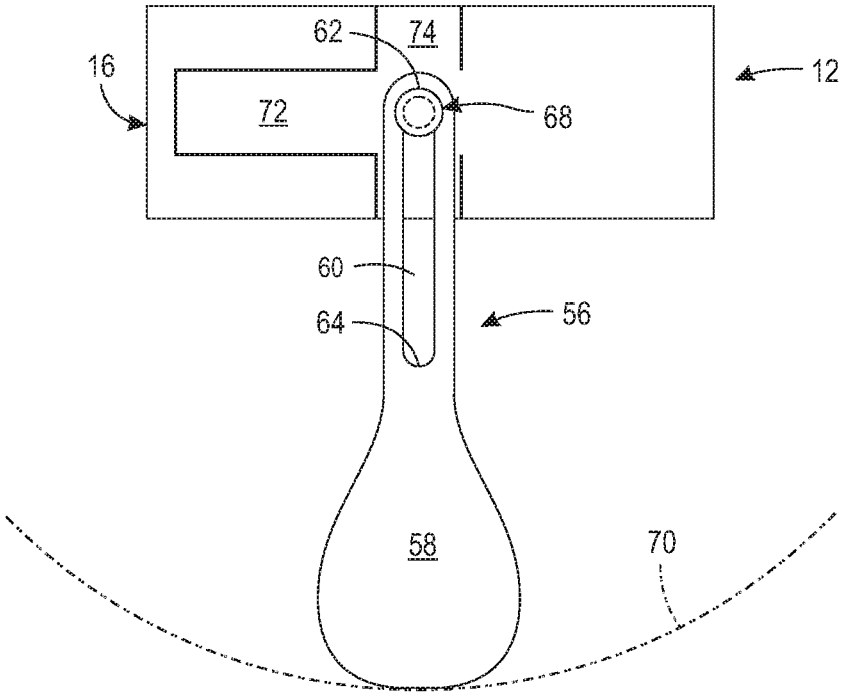
FIG. 6 is a schematic, planar view of another embodiment in which the hand support is selectively positioned away from the storage position.

In a second embodiment, as specifically illustrated in FIG. 6, much of same design for the hand support is employed, except the back side of each one of pads 12 and 14 is provided with a first channel 72, to facilitate storage and sliding of the paddle in the longitudinal direction of the pad, and a second channel 74, to facilitate positioning of the paddle in a direction transverse to channel 72. As with the first embodiment, the construction of the back side of pad 14 mirrors the construction of the back side of pad 12.

Figure 7:
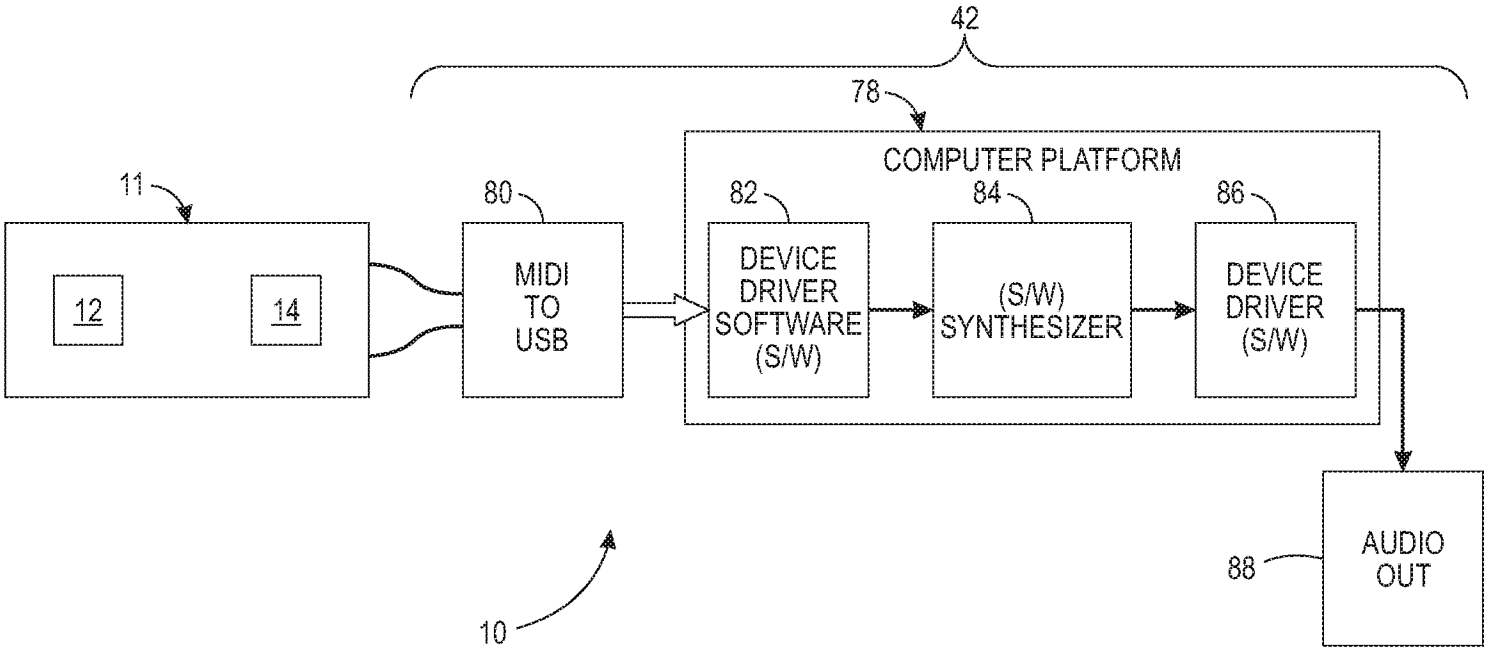
FIG. 7 is s block diagrammatic view illustrating further detail of the electronic musical system of FIG. 1.

Referring to FIGS. 1 and 7, the signal processing system 42 for generating musical sounds, responsive to signals (e.g., "MIDI Messages") produced by the pads 12 and 14, is now described. In the exemplary approach of FIG. 7, the input section 11 comprises a MIDI controller communicating with a computer 78 by way of a suitable MIDI to USB interface 80. As further shown in FIG. 7, the computer 78 may be provided with device driver software 82, on the front end, for permitting MIDI Messages to be communicated to a software implemented synthesizer 84. In accordance with conventional technology, the software synthesizer generates tones, namely digital audio, corresponding with the MIDI Messages.

Although shown as a "wired" system, it is also contemplated that one or more of the communication channels employed in system 10 may be a wireless channel as well (e.g., BlueTooth, Wi-Fi, etc.). Furthermore, as contemplated by FIG. 7, information is generated with the pads 12, 14 of MIDI controller 11, and communicated to the MIDI to USB interface 80. Alternatively, the MIDI to USB interface 80 could be incorporated into the MIDI controller 11 or each one of the subsystems 12 and 14. As will be appreciated, in at least one exemplary embodiment the MIDI controller 11 would need a source of power, either from an associated power supply, which may be a wired connection (e.g., USB supplied power), or may be in the form of a battery or another portable supply for power.

In yet another variation of the embodiment depicted in the figures the functionality of the MIDI controller as well as other components of the disclosed processing system 42 may be implemented through the use of a computer or other processor in response to programmatic instructions. This software-driven system could create MIDI or other synthesizer inputs in response to signals from the subsystems 12 and 14. As an example, the signals from subsystems 12 and 14 may be received through conventional input/output (I/O) ports of the computer 78, transmitted via wired or wireless connections with the computer, and processed in a manner similar to that described to produce the MIDI or synthesizer information in response to the state changing device(s).

Referring still to FIGS. 1 and 7, a manner in which a MIDI message may be generated can now be more fully understood. As an input is generated by touching one of the touch sensitive elements 28, selected electronic information or data (corresponding to, for instance, finger designation and/or note duration) is produced. As explained in further detail below, in one preferred example of operation, generation of data from subsystem 12 and/or subsystem 14 is constrained by a given state of either state altering element 53 or 54. In turn, the selected data from the subsystem 12 or 14 is communicated to electronic subsystem 24, the electronic subsystem 24 being preprogrammed to generate a MIDI Message. Each generated MIDI Message corresponds with one or more digital audio outputs that are produced by the software synthesizer 84 in response to receiving the MIDI Message. Software tools for programming software synthesizers to correspond MIDI Messages with certain preselected outputs are available from the one of several software vendors. In response to the software synthesizer 84 producing digital audio output from the MIDI messages, a device driver software 86 permits consumable audio output to be delivered to an audio device 88. The audio device, in one example, can be speakers included with or operatively connected to the computer 78.

Figure 8:
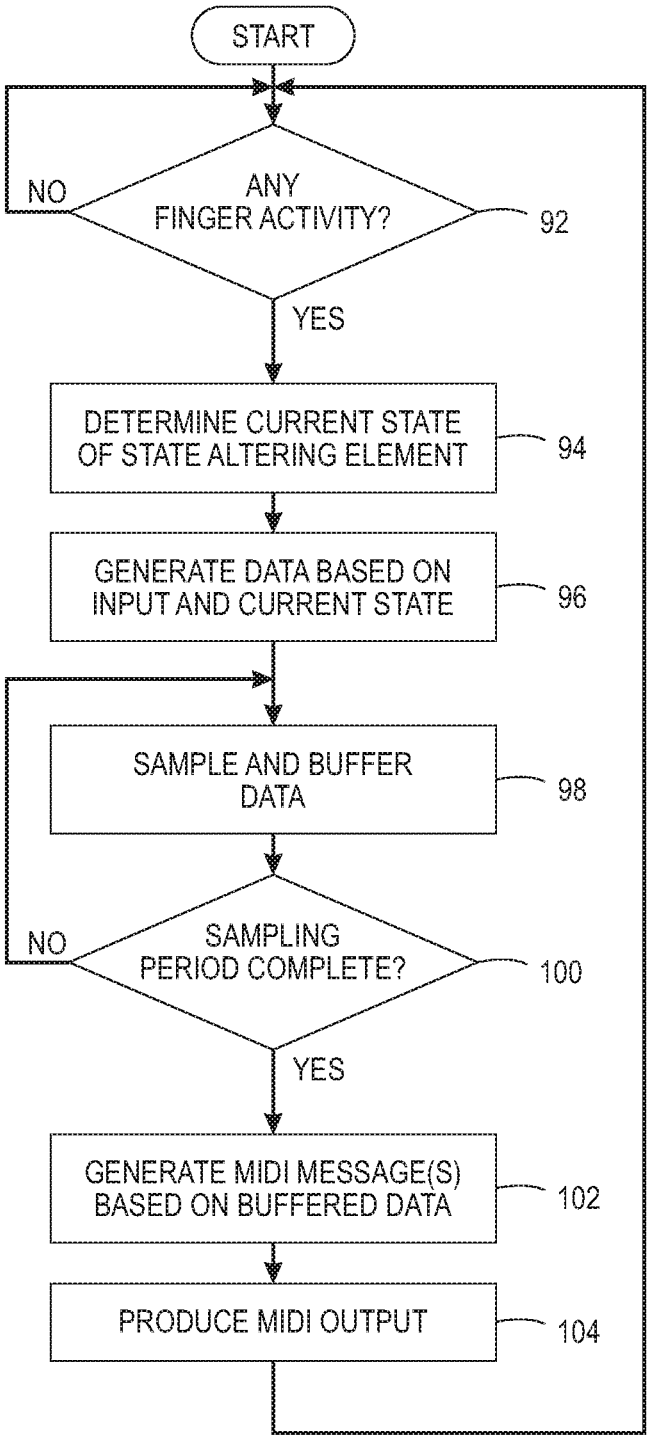
FIG. 8 is a flow diagram illustrating an exemplary process for producing MIDI output(s) with the disclosed electronic musical system.

Referring now to FIG. 8, a process for generating MIDI Messages with MIDI controller 11, and using the same, with the MIDI signal processing system 42 to produce corresponding musical sounds or outputs is described. As will be appreciated by those skilled in the art, the MIDI Messages are generated by collecting information or data from the subsystems 12, 14 and creating appropriate signals for consumption with the MIDI signal processing system 78. Moreover, the logic and short term memory necessary to generate the MIDI Messages may be obtained with the electronic subsystem 24.

Referring initially to inquiry 92 of the flow diagram in FIG. 8, a check is performed to determine if there is any finger activity, i.e., whether any one of the touch sensitive elements 28 have been engaged. Assuming a touch element has been pressed, a current state, as set with one of the state altering elements 53, 54, is determined at 94. As suggested above, each one of state altering elements 53, 54 can be employed to shift the musical output of the touch sensitive elements 28. In one example, obtaining the state of either subsystem 12 or 14, permits a musical output corresponding to a given touch sensitive element to be produced in one of several states, e.g., one of several octaves.

In one example of operation, touch sensitive elements 32-35 may be respectively assigned to musical outputs A B C D, and touch sensitive elements 44-47 respectively to E F G A. Note that the term "output," as used in the present disclosure, can refer to the output for a single musical note or the collective output of a series of related notes, such as a musical scale (e.g., ABCD) or chord (e.g. AC). In the present example, when the state altering element 53 of subsystem 12 is in one state, the output may correspond to one of several octaves and, when element 53 is in a second state, the output may correspond with another of several octaves. As contemplated, all of the octaves for a given keyboard instrument can be selected and generated with a given type of element 53 or 54, such as a scroll wheel. Using a scroll wheel, for instance, either one of elements 53 or 54 can be configured to move tonal output either upscale (by scrolling in one direction), or downscale, (by scrolling in another direction).

Alternatively, one or more of the touch sensitive elements 28 may be further employed or configured to move tonal output either upscale (by continuously pressing of one element), or downscale, (by continuously pressing a second element). Selection or alteration of the scale may be done in alternative ways as well. Also contemplated, particularly where one or more touch sensitive elements may be employed to switch or shift scale, is an embodiment whereby an optional visual indicator 180, such as a display screen, light(s), etc., may be used to illustrate the selected scale at any particular time. The intent of such a feature is to provide to the user an indication of which scale(s) the system is currently operating in. Similar visual feedback could be provided to the user with optional signaling lights (e.g., LEDs 182) that output different colors in response to the selected scale, or provide output at different positions as the scale is changed. Such a display or signaling feature may also be associated with the pads 12 and/or 14, so that the user is provided with feedback on the selection or change as it is made. And, with an indicator 180 such selections may be immediately reflected via a corresponding display element 182. Moreover, such settings may be further identified in some manner on the pad surface, including text, iconic representation and the like. Of course, the disclosed embodiments also contemplate the use of conventional input devices such as an ASCII keyboard or mouse, perhaps in conjunction with the software synthesizer or similar software, to facilitate selections and changes of octaves, keys, instruments and the like.

Referring still to FIG. 8, data, responsive to finger activity being detected at step 92 and the state determination being made at step 94, is generated at step 96. This data is sampled at preselected intervals with the electronic subsystem 24, and then, in one example, buffered/processed at the same electronic subsystem 24 (step 98). As will be appreciated by those skilled in the art, the sampling interval should be granular enough to capture data corresponding with musical notes of varying duration (including notes with only a fractional duration of a whole note). Moreover, the sampling period should be frequent enough to capture a significant amount of data without creating undesirable gaps or "dead space" in resulting MIDI output. With suitable sampling, smooth reproduction of virtually all musical combinations (including sequential combinations or chords) should be obtainable. Suitable sampling should also permit high quality replication of fractional musical notes (namely musical notes with a duration of less than a whole note, such as half notes associated with touch sensitive elements 36-39 or 48-51).

Based on an inquiry at step 100, once data has been sampled and buffered over a preselected number of time intervals (i.e., a preselected sampling period), electronic subsystem 24, at step 102, generates MIDI Messages for the buffered data. At step 104, MIDI output is produced using the software synthesizer 84 (FIG. 7). In one example of operation, the process of FIG. 8 can be used to conveniently create musical output in one state (possibly a scale in one octave)—by mere manipulation of either state altering element 53 or 54.

Certain exemplary features described above make the disclosed electronic musical system particularly desirable. In one example, the disclosed electronic musical system is easy to use because a pad is provided for employment with each hand. In another example, the disclosed electronic musical system can be constructed inexpensively since expensive components, such as a reasonably high-powered processor (suitable for use with a far more complex platform) and extensive memory (suitable for storing large amounts of data), are not required. In yet another example, each pad is provided with a hand support, the hand support greatly facilitating use of each pad by creating a virtual connection between a user's hand and an associated pad. In yet another example, each hand support is easily and securely stored along a backside of an associated pad, and, during use, each hand support is easily positioned to accommodate for the preference of a given user. In another example, musical output of the electronic music system can be readily varied by use of state altering elements as well as making appropriate adjustments to (1) the electronic subsystem(s) and (2) the MIDI software synthesizer.

It will be appreciated that various of the above-disclosed embodiments and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A portable electronic musical system, comprising:

a hand pad, including a plurality of touch sensitive elements, usable with a single hand, wherein information corresponding with a musical note is produced when a selected amount of pressure is applied to one of the plurality of touch sensitive elements, where said hand pad includes a casing with a front side and a back side, wherein said selectively positionable support mechanism includes an elongate member operatively secured to and pivotal relative to the back side of the casing;

an electronic subsystem, operatively associated with said hand pad, for capturing the information produced as a result of pressure being applied to the one of the plurality of touch sensitive elements;

a sound producing subsystem, operatively communicating with said electronic subsystem, for receiving the captured information from said electronic subsystem and producing musical output with the captured information; and a selectively positionable support mechanism operatively connected to said hand pad, wherein, when said hand pad is used with the single hand, at least part of the selectively positionable support mechanism is positioned under at least part of the single hand so that all of said hand pad, said positionable support mechanism and the single hand are movable in unison.

2. The portable electronic musical system according to claim 1, further including a biasing member, wherein the elongate member is operatively secured to the back side of the casing using the biasing member.

3. The portable electronic musical system according to claim 2, wherein the biasing member includes a spring loaded pin disposable in a first position and a second position, and wherein the elongate member is movable, relative to the back side of the casing when the spring loaded pin is disposed in the first position, and secured to the back side of the casing when the spring loaded pin is disposed in the second position.

4. The portable electronic musical system according to claim 2, in which the back side of the casing includes a long edge and a short edge, and in which the elongate member includes a slot, wherein the slot is positionable with respect to the biasing member so that the elongate member can slide relative to the biasing member to selectively position the elongate member relative to the short edge of the back side of the casing.

5. The portable electronic musical system according to claim 4, in which the back side of said casing includes a channel for receiving a portion of the elongate member, wherein the elongate member is moved in the channel when the elongate member slides relative to the biasing member.

6. The portable electronic musical system according to claim 2, wherein the elongate member may be pivoted about the biasing member to position the elongate member relative to the single hand.

7. The portable electronic musical system according to claim 6, in which the back side of the casing includes at least one channel for receiving a portion of the elongate member, wherein the portion of the elongate member is received by the channel when it is pivoted about the biasing member to position the elongate member relative to the single hand.

8. The portable electronic musical system of claim 1, in which the elongate member includes two opposing sides and in which one of the two opposing sides is positioned under the single hand when said hand pad is in use, wherein the other of the two opposing sides comprises a tacky material preventing any substantial slipping of the elongate member.

9. The portable electronic musical system according to claim 1, in which said sound producing subsystem is adapted to produce a first musical output and a second musical output different from the first musical output, wherein said hand pad includes a state altering element disposable in one of a first state and a second state, and wherein said sound producing subsystem produces (a) the first musical output when the state altering element is disposed in the first state, and (b) the second musical output when the state altering element is disposed in the second state.

10. The portable electronic musical system according to claim 9, wherein the at least one state altering element is selected from the group consisting of: a switch, a multi-position switch, an encoder, a hall-effect encoder, a roller-switch, a scroll wheel, a scroll ball, a trackball, a joystick, and a sensor.

11. The portable electronic musical system according to claim 10, wherein said sound producing subsystem comprises a MIDI synthesizer, said MIDI synthesizer communicating with said electronic subsystem, and selectively producing at least one of the first musical output and the second musical output.

12. A keyboard for an electronic musical system, comprising a first hand pad, including a plurality of touch sensitive elements, wherein a first set of information corresponding with a first musical output is produced when a selected amount of pressure is applied to one of the plurality of touch sensitive elements of the first hand pad by a user, and wherein said first hand pad is used with one of a user's left hand and right hand; and a first selectively positionable support mechanism, said first selectively positionable support mechanism includes an elongate member operatively secured to and pivotal relative to the back side of the first hand pad, the first selectively positionable support mechanism being operatively connected with said first hand pad and in contact with the one of the user's left hand and right hand when the first hand pad is in use.

13. The keyboard for the electronic musical system according to claim 12, further comprising:

a second hand pad, including a plurality of touch sensitive elements and being separate from said first hand pad, wherein a second set of information corresponding with a second musical output is produced when a selected amount of pressure is applied to one of the plurality of touch sensitive elements of the second hand pad, and wherein said second hand pad is used with the other one of the user's left hand and right hand; and a second selectively positionable support mechanism, said second selectively positionable support mechanism includes an elongate member operatively secured to and pivotal relative to the back side of the second hand pad, the second selectively positionable support mechanism being operatively connected with said second hand pad and in contact with the other one of the user's left hand and right hand when the second hand pad is in use.

14. The keyboard for the electronic musical system according to claim 13, further comprising a sound producing subsystem, operatively communicating with said first and second pads, said sound producing subsystem being capable of producing the first musical output with the first set of information and producing the second musical output with the second set of information.

15. A portable electronic musical system, comprising:

a hand pad, including an upper surface with a plurality of touch sensitive elements thereon, usable with a single hand, wherein information corresponding with a musical note is produced when pressure is applied to at least one of the plurality of touch sensitive elements;

a state altering element for selection of one of a plurality of states;

an electronic subsystem, operatively associated with said hand pad, for capturing information corresponding with the musical note and the selected state;

a sound producing subsystem, operatively communicating with said electronic subsystem, producing musical output in response to the captured information and the selected state from said electronic subsystem; and a selectively positionable support mechanism operatively connected to said hand pad, wherein, when said hand pad is used with the single hand, at least part of the selectively positionable support mechanism is positioned under at least part of the single hand so that all of said hand pad, said positionable support mechanism and the single hand are movable in unison.

16. The portable electronic musical system according to claim 15 wherein a movement of the state altering element results in a change of a signal output by the state altering element to change the selection of one of a plurality of states.

17. The portable electronic musical system according to claim 15 wherein the state altering element includes a sensor for sensing motion thereof.

* * * * *